US009951534B2

(12) United States Patent
Menges

(10) Patent No.: US 9,951,534 B2
(45) Date of Patent: Apr. 24, 2018

(54) SIDING GAUGE FOR MEASURING VERTICAL GAP AND HORIZONTAL OVERLAP

(71) Applicant: Thomas Menges, Lexington, KY (US)

(72) Inventor: Thomas Menges, Lexington, KY (US)

( * ) Notice: Subject to any disclaimer, the term of this patent is extended or adjusted under 35 U.S.C. 154(b) by 206 days.

(21) Appl. No.: 15/085,809

(22) Filed: Mar. 30, 2016

(65) Prior Publication Data

US 2016/0289981 A1 Oct. 6, 2016

Related U.S. Application Data

(60) Provisional application No. 62/140,109, filed on Mar. 30, 2015.

(51) Int. Cl.
*E04F 21/00* (2006.01)
*E04F 21/18* (2006.01)

(52) U.S. Cl.
CPC ..... *E04F 21/1855* (2013.01)

(58) Field of Classification Search
CPC ..... E04F 21/1855
USPC ..... 33/646
See application file for complete search history.

(56) References Cited

U.S. PATENT DOCUMENTS

| | | | | | |
|---|---|---|---|---|---|
| 520,511 | A * | 5/1894 | Wint | E04F 21/1855 | 33/646 |
| 742,571 | A * | 10/1903 | Blohm | E04F 21/1855 | 33/646 |
| 4,879,818 | A * | 11/1989 | Beaulieu | G01B 3/30 | 33/646 |
| D681,485 | S * | 5/2013 | Alvarez | D10/64 | |
| 9,683,826 | B2 * | 6/2017 | Cupertino | G01B 3/30 | |
| 2016/0289981 | A1 * | 10/2016 | Menges | E04F 21/1855 | |

* cited by examiner

*Primary Examiner* — Yaritza Guadalupe-McCall

(57) ABSTRACT

A device for maintaining recommended spacing during siding installation contains a main body, an extended body, an extruding body, a first channel, and a second channel. The first channel and the second channel are used to receiving a siding panel. When the siding panel is received, a first stop and a second stop of the extruding body is used to rest the device against a previously installed siding panel. Since the siding panel is stationary against the previously installed siding panel, a constant space can be maintained between the two siding panels. In addition to installing the siding panel, the device can also be used when installing siding butt-joints. In order to do so, a first receiving channel and a second receiving channel are provided.

12 Claims, 5 Drawing Sheets

SIDING GAUGE FOR MEASURING VERTICAL GAP AND HORIZONTAL OVERLAP

The current application claims a priority to the U.S. Provisional Patent application Ser. No. 62/140,109 filed on Mar. 30, 2015.

FIELD OF THE INVENTION

The present invention relates generally to the installation of siding panels. More specifically, the present invention is used to maintain a constant space between siding panels. By utilizing the present invention, the user can complete a siding wall with no inconsistent spacing between two siding panels.

BACKGROUND OF THE INVENTION

Installation of siding is a very tedious task that requires precision. Standard practice of maintaining the recommended vertical and butt gap of one-eighth of an inch is to eyeball or guess the width of the gap or even manually measure the width of the gap. This standard practice of determining the width of the gap results in a large margin of human error and inconsistent results throughout the entire siding.

When eyeballing the position of a siding panel there is a high probability for the spacing between two siding panels to be different from one another. Even though the differences can be minimum between two siding panels, when an entire section is complete, the minimum differences between siding panels can have a considerable impact on the overall outlook.

Most siding panels need to be installed exactly according to the manufacturer's instructions. Failure to do so, can result in damaged siding panels. As an example, improper clearances from roof surfaces, decks, steps and other hard surfaces can result in damaging the siding panels. Therefore, the need for a quick and convenient method of measuring these distances is clearly evident.

Properly attaching siding panels is a vital part of the installation process. Failure to do so, can result in hindering the aesthetically pleasing appearance of the siding panel and also damaging the siding panel. As an example, angularly driven nails and overdriven nails are instances where the siding panel is damaged. On most instances, angularly driven nails are a result of attempting to maintain a constant overlap between two siding panels. The present invention is designed such that the user can continue the installation process while keeping the second siding panel stationary against the first siding panel.

The objective of the present invention is to address the aforementioned issues. In order to do so, the present invention introduces an apparatus that allows the user hold and align a siding panel at a preferred distance from the previously installed siding panel. By doing so, the siding panels can be installed such that equal spacing is maintained throughout the process.

DETAIL DESCRIPTIONS OF THE INVENTION

All illustrations of the drawings are for the purpose of describing selected versions of the present invention and are not intended to limit the scope of the present invention.

The present invention is intended to be used during the process of installing siding panels. In particular, the present invention is designed to eliminate human errors and to improve efficiency of the installation process. By utilizing the present invention spacing issues which are common in siding installation can be avoided. Moreover, the siding installation process can be completed with greater accuracy and efficiency.

Figure 1:
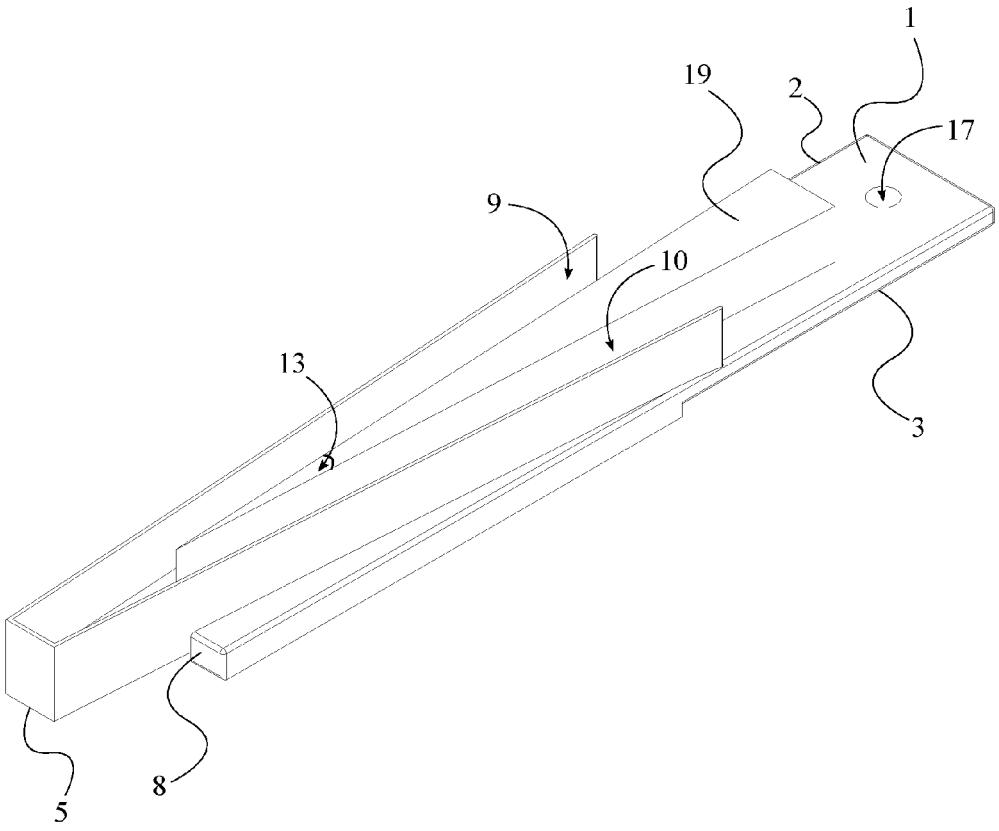
FIG. 1 is a perspective view of the present invention.
Figure 2:
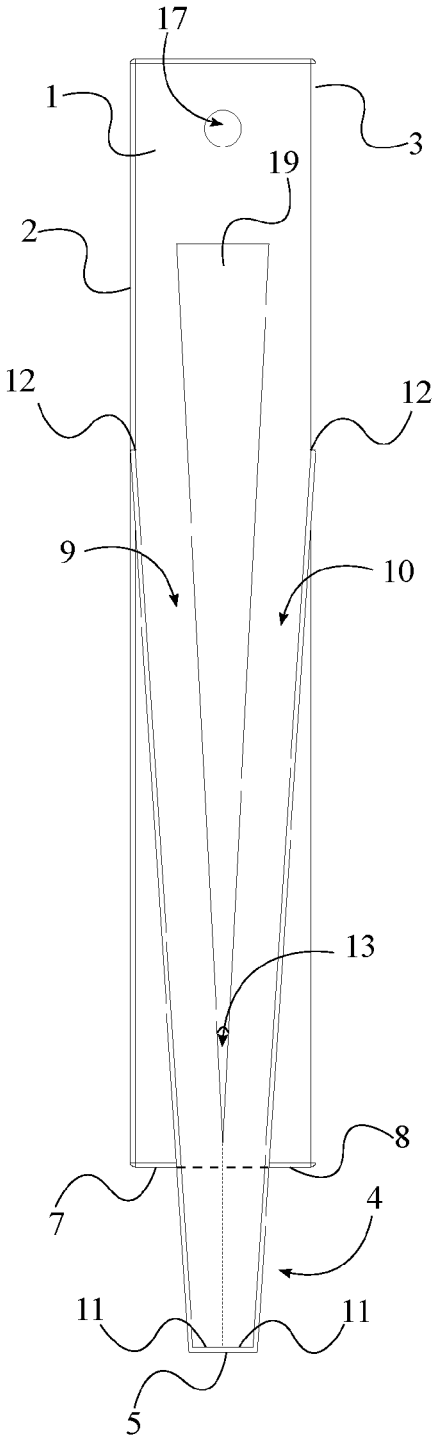
FIG. 2 is a top view of the present invention.
Figure 3:
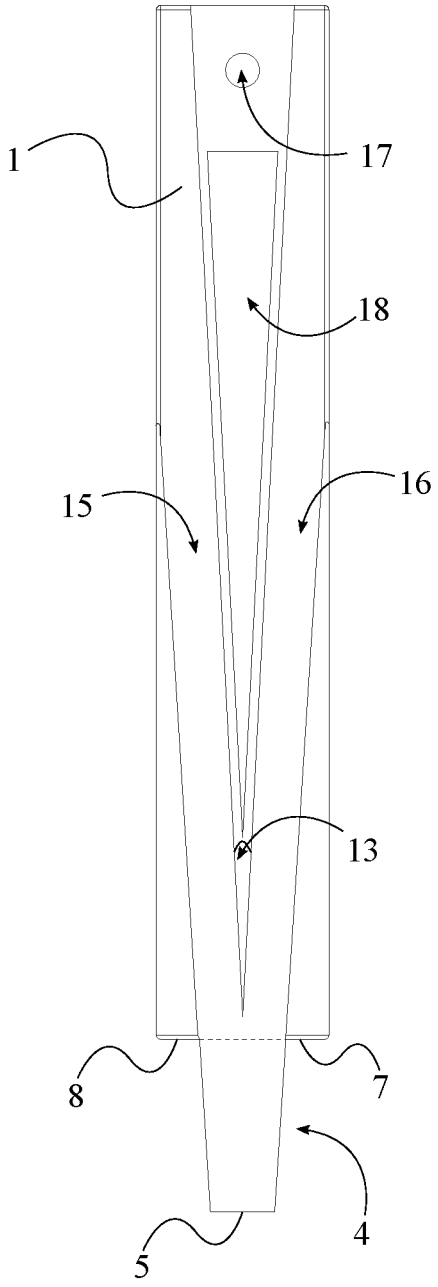
FIG. 3 is a bottom view of the present invention.
Figure 4:
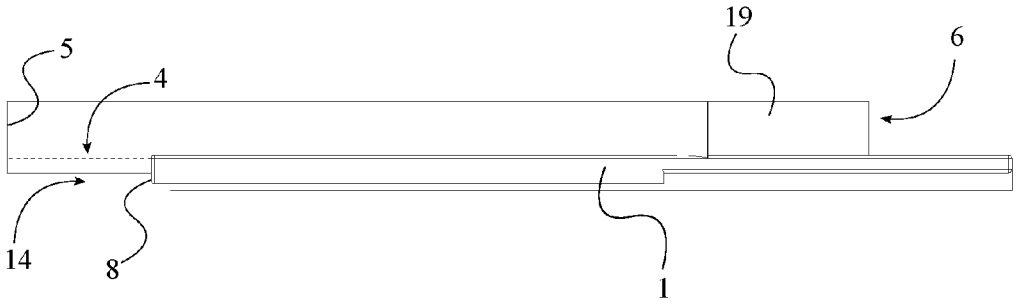
FIG. 4 is a side view of the present invention.

As seen in FIGS. 1-4, in order to help with the installation process, the present invention comprises a main body 1, an extended body 4, an extruding body 6, a first channel 9, and a second channel 10. The main body 1 is made of a durable lightweight material and is rectangular in shape. Functionality wise, the main body 1 is used as a platform for holding the remaining components of the present invention. The extended body 4, which is trapezoidal in shape, is terminally connected to the main body 1. In particular, the extended body 4 is used to angularly position the first channel 9 and the second channel 10. The extruding body 6 determines the depth of the first channel 9 and the second channel 10. In order to do so, the extruding body 6 protrudes from the main body 1 and the extended body 4 as seen in FIG. 4. The height of the extruding body 6 allows a firm connection to be established with an edge of a siding panel. When in use, the present invention is rested on a previously installed siding panel. Then, a subsequent siding panel is installed at a preferred distance from the previously installed siding panel. In doing so, the siding panel is placed within the first channel 9 or the second channel 10. In order to receive the siding panel, the first channel 9 and the second channel 10 laterally traverses into the extruding body 6 towards the main body 1 and the extended body 4. The traversing is such that the first channel 9 is positioned at an acute angle 13 to the second channel 10. Moreover, the first channel 9 and the second channel 10 are mirrored across the main body 1. The symmetry between the first channel 9 and the second channel 10 allows the operator to use the present invention in a preferred direction. When the subsequent panel is placed within the first channel 9 or the second channel 10, the present invention needs to be rested on the previously installed siding panel. In order to do so, the extruding body 6 comprises a first stop 7 and a second stop 8. The availability of the second stop 8 allows the operator to orient the present invention as preferred. The first channel 9 and the second channel 10 are positioned in between the first stop 7 and the second stop 8 so that the present invention can be rested on the previously installed siding panel upon receiving the subsequent siding panel. As an example, if the subsequent siding panel is placed in the first channel 9, the first stop 7 is used to rest the present invention on the previously installed siding panel. In order to do so, the first stop 7 is positioned adjacent the first channel 9 and opposite the second channel 10. Similarly, if the subsequent siding panel is positioned in the second channel 10, the second stop 8 is used to rest the present invention against the previously installed siding panel. In order to do so, the second stop 8 is positioned adjacent to the second channel 10 and opposite the first channel 9.

As mentioned above, when the first channel 9 and the second channel 10 laterally traverses towards the main body 1 and the extended body 4 a separating body 19 of the extruding body 6 is created. The separating body 19 which is positioned in between the first channel 9 and the second channel 10 allows the user to guide the siding panel along the first channel 9 or the second channel 10 with minimum difficulty.

The present invention is also designed to accommodate the installation of butt joints. The present invention comprises a rear extruding body 14, a first receiving channel 15, and a second receiving channel 16 to accommodate the installation of butt joints. The rear extruding body 14 protrudes from the main body 1 and the extended body 4 in a direction opposite to the extruding body 6. As before, the first receiving channel 15 and the second receiving channel 16 also laterally traverses the rear extruding body 14 towards the main body 1 and the extended body 4. In doing so, the first receiving channel 15 is angularly positioned at an acute angle 13 to the second receiving channel 16. The first channel 9, the second channel 10, the first receiving channel 15, and the second receiving channel 16 are all identical to each other but different in positioning. As an example, the first receiving channel 15 is positioned about the main body 1 and the extended body 4 opposite to the first channel 9. Likewise, the second receiving channel 16 is positioned about the main body 1 and the extended body 4 opposite the second channel 10. Moreover, the first receiving channel 15 and the second receiving channel 16 are also mirrored across the main body 1. Therefore, the present invention can be used in any direction according to user preference.

As mentioned before, the extended body 4 is used to angularly position the first channel 9 and the second channel 10. In addition to doing so, the extended body 4 also helps position the first stop 7 adjacent the first channel 9 and then the second stop 8 adjacent to the second channel 10. The extended body 4 comprises a distal end 5 such that the main body 1 tapers towards the distal end 5. The tapering helps create the trapezoidal shape mentioned before.

The first channel 9 and the second channel 10 are designed so that the siding panel can be conveniently slid into the first channel 9 or the second channel 10. As an example, when inserting the siding panel to the first channel 9, the siding panel is inserted in at a second end 12 of the first channel 9 and then pushed towards a first end 11 of the first channel 9. The first end 11 is aligned with the distal end 5 as seen in FIG. 2. Since the first channel 9 and the second channel 10 are identical to each other, the second channel 10 also comprises a first end 11 and a second end 12. The first end 11 of the second channel 10 is also aligned with the distal end 5. When considering the overall positioning of the first channel 9 and the second channel 10 which are aligned at the distal end 5, the first channel 9 and the second channel 10 are positioned in between a first lateral edge 2 of the main body 1 and a second lateral edge 2 of the main body 1.

As experienced by individuals in the industry, the need to carry multiple tools simultaneously can be a daunting task. In order to address the issue, the present invention comprises a hanging hole 17. In addition to carrying, the hanging hole 17 can also be utilized when storing the present invention. In the preferred embodiment of the present invention, the hanging hole 17 traverses through the main body 1 and is centrally positioned on the main body 1. Moreover, the hanging hole 17 is positioned opposite the extended body 4 and along the main body 1. The position of the hanging hole 17 can vary in different embodiments of the present invention as long as the overall functionality of the present invention is not hindered.

Maintaining a firm grip with a tool is essential in any industry. In order to help the operator hold the present invention more effectively, the present invention comprises an opening 18 which traverses through the rear extruding body 14. The opening 18 allows the user to insert fingers such that the present invention is held firmly. In the preferred embodiment of the present invention, the opening 18 is triangular in shape as shown in FIG. 3. However, the shape of the opening 18 can differ in other embodiments of the present invention.

Figure 5:
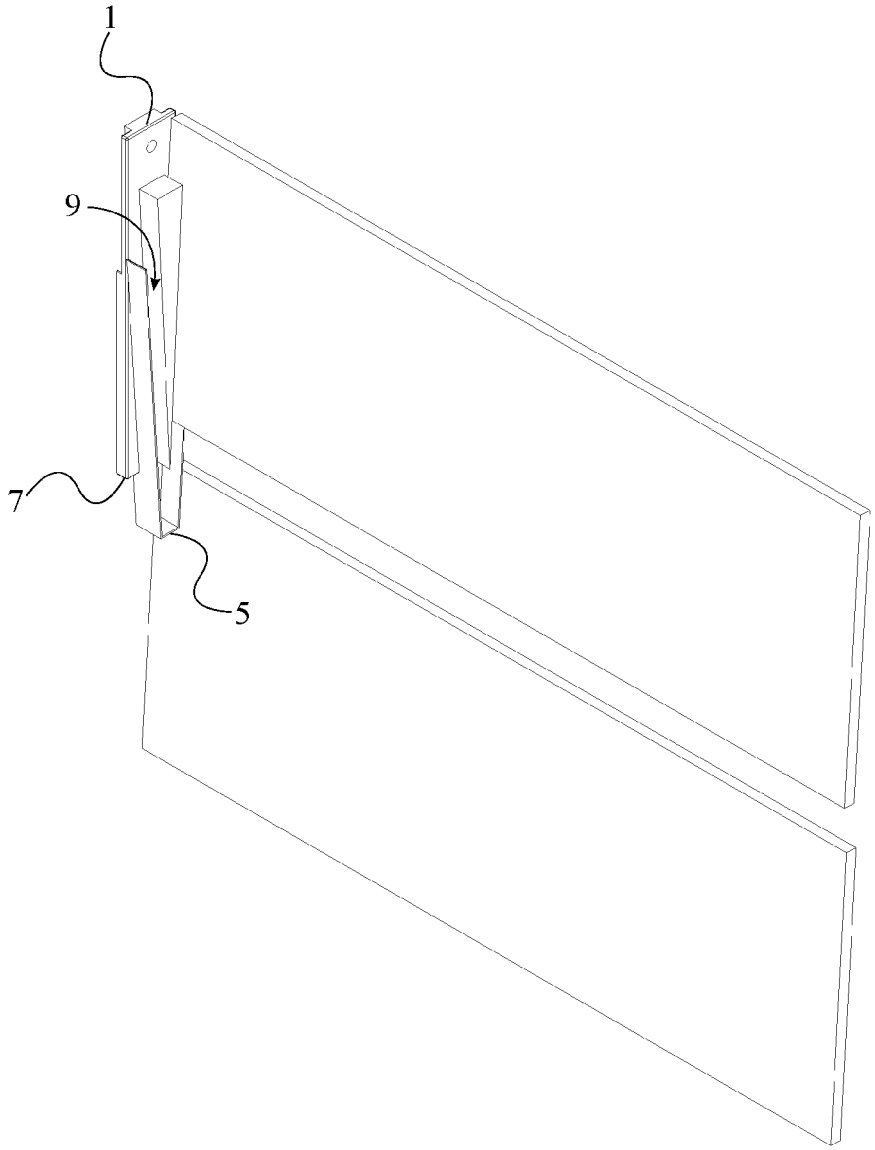
FIG. 5 is an illustration of the present invention being used to install a siding panel.

When utilizing the present invention, the following process flow is generally followed. Initially a starter siding strip is fixed at a bottom of a wall. Next, a proximal end of a siding panel is placed within the second channel. Similarly, a distal end of the siding panel is placed within the first channel 9. Since the present invention is used in pairs, siding panels of different lengths can be conveniently installed. Next, the siding strip is positioned above the starter siding strip such that the first stop 7 and the second stop 8 rest against the starter siding strip as illustrated in FIG. 5. When positioned at the required distance, a center portion of the siding strip is attached to the wall. Upon attaching the center portion, the present invention is pulled downwards allowing the user to attach the proximal end and the distal end. The width of the main body 1, offsets the proximal end and the distal end at a preferred distance. The process is then continued to cover the surface area of the wall.

When a butt joint needs to be installed the following process flow is generally followed. Similar to the process of fastening the siding panel, a first cut portion of the siding panel is positioned at a specific distance from the corner board. When the present invention is being used, the specific distance is equal to the width of the main body 1. Next, a second cut portion of the siding panel is positioned at a specific distance from the corner board opposite the first cut portion. Both the first cut portion and the second cut portion are installed in a manner similar to installing the siding panel. However, when the second cut portion is installed adjacent to the first cut portion, the first receiving channel or the second receiving channel is used to receive the first cut portion. When a center portion of the second cut portion is attached adjacent to the first cut portion, the present invention is pulled out. Afterwards, a piece of flashing is inserted behind a joint between the first cut section and the second cut section. When the piece of flashing is successfully installed, the first cut portion and the second cut portion is fastened to the wall along with the piece of flashing.

Although the invention has been explained in relation to its preferred embodiment, it is to be understood that many other possible modifications and variations can be made without departing from the spirit and scope of the invention as hereinafter claimed.

What is claimed is:

1. A siding gauge for measuring the vertical gap and the horizontal overlap when placing siding panels comprises:

a main body;

an extended body;

an extruding body;

a first channel;

a second channel;

the extruding body comprises a first stop and a second stop;

the extended body being terminally connected to the main body;

the extruding body protruding from the main body and the extended body;

the first channel and the second channel laterally traversing into the extruding body towards the main body and the extended body;

the first channel being angularly positioned to the second channel at an acute angle;

the first channel and the second channel being positioned in between the first stop and the second stop;

the first stop being positioned adjacent to the first channel opposite the second channel; and the second stop being positioned adjacent to the second channel opposite the first channel.

2. The siding gauge for measuring the vertical gap and the horizontal overlap when placing siding panels as claimed in claim 1 further comprises:

a rear extruding body;

a first receiving channel;

a second receiving channel;

the rear extruding body protruding from the main body and the extended body opposite the extruding body;

the first receiving channel and the second receiving channel laterally traversing into the rear extruding body towards the main body and the extended body; and the first receiving channel being angularly positioned to the second receiving channel at an acute angle.

3. The siding gauge for measuring the vertical gap and the horizontal overlap when placing siding panels as claimed in claim 2 further comprises:

the first receiving channel being positioned about the main body and the extended body opposite the first channel; and the second receiving channel being positioned about the main body and the extended body opposite the second channel.

4. The siding gauge for measuring the vertical gap and the horizontal overlap when placing siding panels as claimed in claim 2, wherein the first receiving channel and the second receiving channel are mirrored across the main body.

5. The siding gauge for measuring the vertical gap and the horizontal overlap when placing siding panels as claimed in claim 2 further comprises:

an opening; and the opening traversing through the rear extruding body.

6. The siding gauge for measuring the vertical gap and the horizontal overlap when placing siding panels as claimed in claim 5, wherein the opening is triangular in shape.

7. The siding gauge for measuring the vertical gap and the horizontal overlap when placing siding panels as claimed in claim 1 further comprises:

the extended body comprises a distal end; and the main body being tapered towards the distal end.

8. The siding gauge for measuring the vertical gap and the horizontal overlap when placing siding panels as claimed in claim 1 further comprises:

the first channel and the second channel each comprises a first end and a second end;

the first end of both the first channel and the second channel align with a distal end of the extended body; and the first channel and the second channel being positioned in between a first lateral edge and a second lateral edge of the main body.

9. The siding gauge for measuring the vertical gap and the horizontal overlap when placing siding panels as claimed in claim 1 further comprises:

the extruding body comprises a separating body; and the separating body being positioned in between the first channel and the second channel.

10. The siding gauge for measuring the vertical gap and the horizontal overlap when placing siding panels as claimed in claim 1 further comprises:

a hanging hole;

the hanging hole traversing through the main body;

the hanging hole being positioned opposite the extended body along the main body; and the hanging hole being centrally positioned on the main body.

11. The siding gauge for measuring the vertical gap and the horizontal overlap when placing siding panels as claimed in claim 1, wherein the main body is rectangular in shape.

12. The siding gauge for measuring the vertical gap and the horizontal overlap and placing siding panels as claimed in claim 1, wherein the first channel and the second channel are mirrored across the main body.

* * * * *